US005765829A

United States Patent [19]

Coquereau

[11] Patent Number: 5,765,829

[45] Date of Patent: Jun. 16, 1998

[54] BOARD GAME SIMULATING AN OUTER SPACE ALIEN CHASING CREW MEMBERS IN A SPACESHIP

[76] Inventor: Raoul Coquereau, 2686 Ocean Ave., #A6, Brooklyn, N.Y. 11229

[21] Appl. No.: 804,836

[22] Filed: Feb. 24, 1997

[51] Int. Cl.[6] ..... A63F 3/00

[52] U.S. Cl. ..... 273/250; 273/263

[58] Field of Search ..... 273/263, 253, 273/250, 254, 251, 252, 249, 243

[56] References Cited

U.S. PATENT DOCUMENTS 4,087,094 5/1978 Bakay ..... 273/254

4,120,503 10/1978 Macrory et al. ..... 273/244

5,071,134 12/1991 Burroughs, Jr. ..... 273/249

FOREIGN PATENT DOCUMENTS

WO8103622 12/1981 WIPO ..... 273/251

*Primary Examiner*—Benjamin H. Layno

[57] ABSTRACT

The present invention relates to a boardgame, which is use by a number of game players, simulates an outer space alien chasing crewmembers about a spaceship. The game includes a gameboard, six player pieces, six player cards, an alien piece, 58 alien cards, 60 crew assignment cards and a pair of dice.

4 Claims, 4 Drawing Sheets

FIG 1
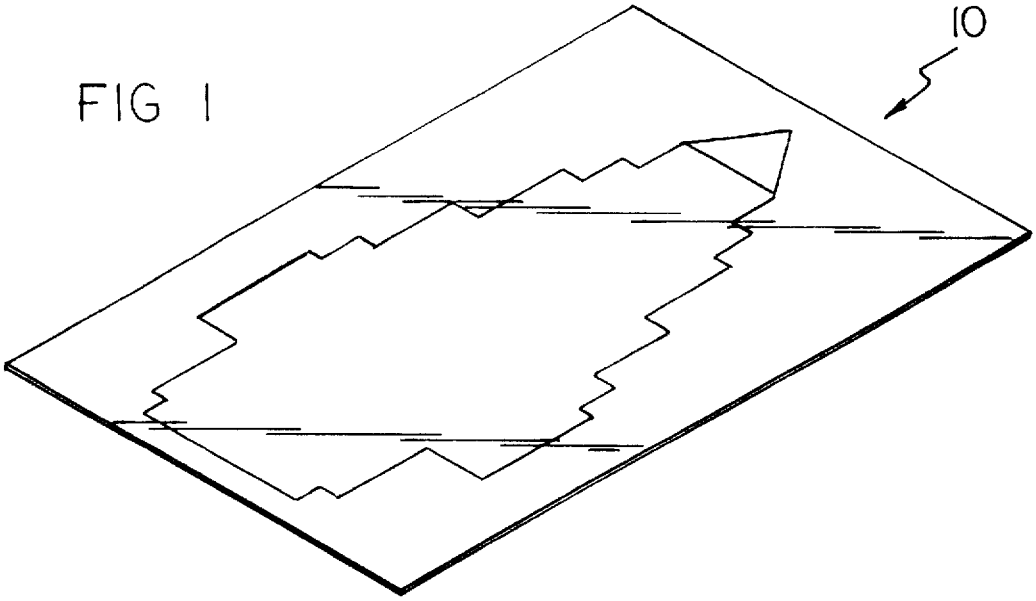
FIG 2
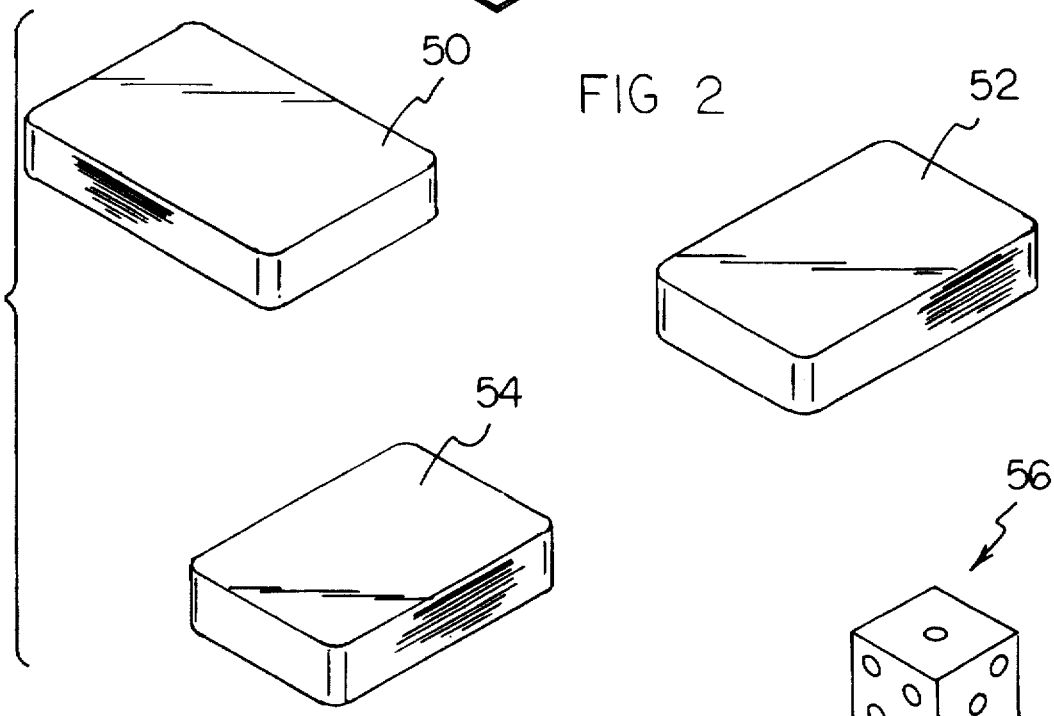
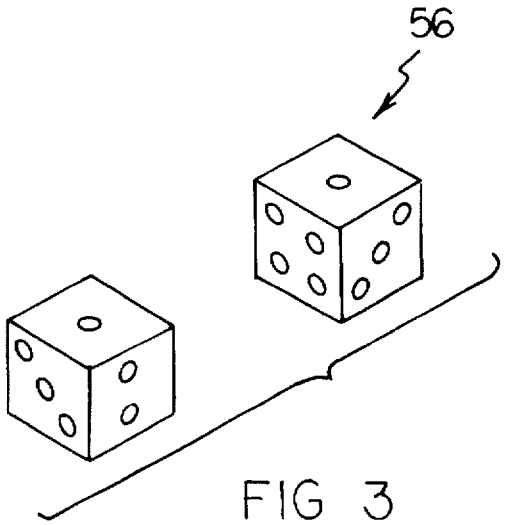
FIG 3

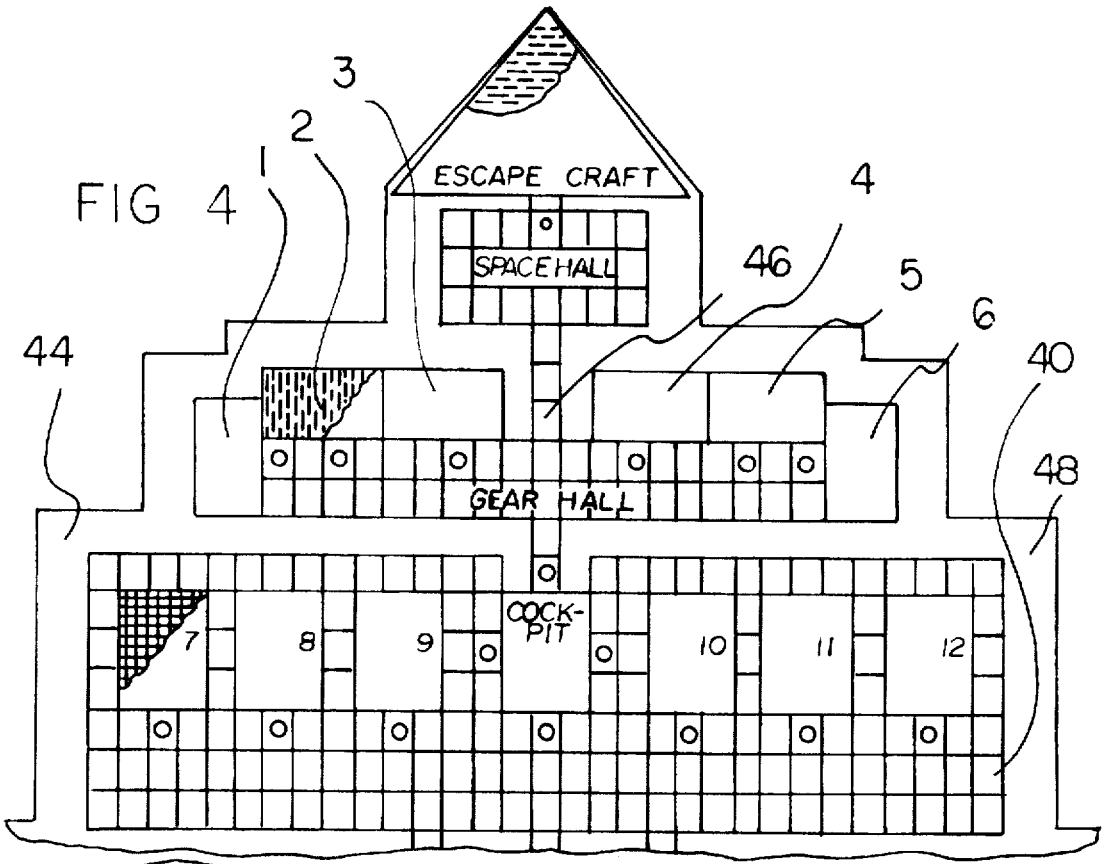
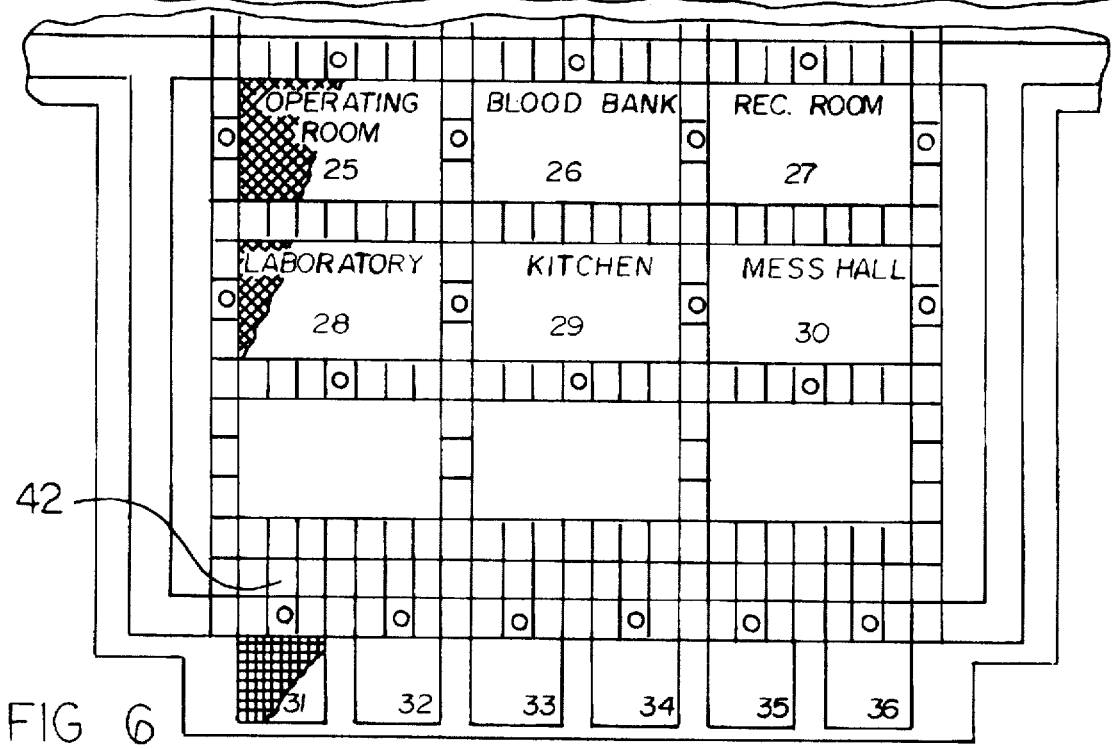
FIG 6

BOARD GAME SIMULATING AN OUTER SPACE ALIEN CHASING CREW MEMBERS IN A SPACESHIP

BACKGROUND OF THE INVENTION

1. Field of the Invention

The present invention relates to an outer space alien terror game and more particularly pertains to a board game simulating an alien attack.

2. Description of the Prior Art

The use of board games is known in the prior art. More specifically, board games heretofore devised and utilized for the purpose of competing against other players are known to consist basically of familiar, expected, and obvious structural configurations, notwithstanding the myriad of designs encompassed by the crowded prior art which has been developed for the fulfillment of countless objectives and requirements.

For example, U.S. Pats. Nos. 5,445,389; 4,579,345; Des. 290,472; 5,104,127; 4,192,512; 4,097,051 all disclose various board games.

In this respect, the out space alien terror game according to the present invention substantially departs from the conventional concepts and designs of the prior art, and in doing so provides an apparatus primarily developed for the purpose of a board game simulating an alien attack.

Therefore, it can be appreciated that there exists a continuing need for new and improved alien terror game which can be used for a board game simulating an alien attack. In this regard, the present invention substantially fulfills this need.

SUMMARY OF THE INVENTION

In view of the foregoing disadvantages inherent in the known types of board games now present in the prior art, the present invention provides an improved alien terror game. As such, the general purpose of the present invention, which will be described subsequently in greater detail, is to provide a new and improved alien terror game and method which has all the advantages of the prior art and none of the disadvantages.

To attain this, the present invention essentially comprises a boardgame simulating an outer space alien pursuing the crew members of a spaceship, the boardgame for use by a number of game players. The game includes a 2' by 3' plastic gameboard having an upper edge and a lower edge and intermediate connecting edges therebetween. This gameboard being divided into a plurality of different levels, a zero flight deck level colored silver, a first locker room level colored purple, a second operations level colored yellow, a third technical support level colored brown, a fourth resource level colored blue, a fifth life support level colored orange, a sixth crew quarter level colored yellow. Additionally, the gameboard is divided into different rooms: an escape craft and space hall spaces located on the zero level, six gear closets spaces and a gear hall space located on the first level, an observatory space, a radio room space, an electrical systems space, a cockpit space, a tracking space, a library technical center space, a weapons room space all located upon the second level, a ballistics space, an air vent systems space, a laser room space, a computer room space, a nuclear reactors space, a repair shop space all located upon the third level, a mineral store space, a grain hold space, a livestock space, a greenhouse space, a water shed space, and an aquarium space all located upon the fourth level, a operating room space, a blood bank space, a recreation room space, a laboratory space, a kitchen space, and a mess hall space all located upon fifth level, a doctor quarters space, a scientist quarters space, a dispatcher quarters space, an engineer quarters space, a co-pilot quarters space and a captain quarters space all located upon the sixth level. A number of different hallways serve to interconnect the different levels, the hallways being segmented into different spaces. Two sets of segments represent ship bulk heads allowing movement to another ship represented by another gameboard. Also, there are three flyways which allow unlimited movement by a gameplayer. The game also includes a number of different crewmember card: a doctor plastic crewmember card, a scientist plastic crewmember card, a dispatcher plastic crewmember card, an engineer plastic crewmember card, a co-pilot plastic crewmember card, a captain plastic crewmember card, each of the crewmember cards are for use in determining the starting location of each crewmember. Furthermore, there are crewmember pieces: a doctor crewmember piece, a scientist crewmember piece, a dispatcher crewmember piece, an engineer crewmember piece, a co-pilot crewmember piece, a captain crewmember piece, each of the crewmember pieces are for indicating a player location upon the gameboard. Sixty plastic crew assignment cards are used to determine what rooms the game players must enter, each card specifies a room upon the gameboard, the cards being color coded to correspond to a level color. A plastic alien piece represents the alien which can be controlled by a gameplayer. Fifty eight plastic alien cards with each card representing a different location upon the gameboard are used in determining the alien location. Finally, two dice are used in moving the various crewmember pieces about the gameboard.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved outer space alien terror game which have all the advantages of the prior art board games and none of the disadvantages.

It is another object of the present invention to provide new and improved alien terror game which may be easily and efficiently manufactured and marketed.

It is further object of the present invention to provide new and improved outer space alien terror game which are of durable and reliable constructions.

An even further object of the present invention is to provide new and improved outer space alien terror game which are susceptible of a low cost of manufacture with regard to both materials and labor, and which accordingly are then susceptible of low prices of sale to the consuming public, thereby making such alien terror game economically available to the buying public.

Still yet another object of the present invention is to provide new and improved outer space alien terror game which provide in the apparatuses and methods of the prior art some of the advantages thereof, while simultaneously overcoming some of the disadvantages normally associated therewith.

Even still another object of the present invention is to a board game simulating an alien attack.

Lastly, it is an object of the present invention to provide new and improved boardgame, which is for use by a number of game players, simulates an alien chasing crewmembers about a spaceship. The game includes a gameboard, six player pieces, six player cards, a alien piece, 58 alien cards, 60 crew assignment cards and a pair of dice.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the alien terror gameboard constructed in accordance with the principles of the present invention.

FIG. 2 is a perspective view of the alien cards, crewmember cards and the crewmember assignment cards.

FIG. 3 is a view of the dice used in determining player movement.

FIG. 4 is partial view of the gameboard utilized with the present invention.

FIG. 6 is a partial view of the gameboard utilized with the present invention.

The same reference numerals refer to the same parts through the various Figures.

DESCRIPTION OF THE PREFERRED EMBODIMENT

With reference now to the drawings, and in particular to FIG. 1 thereof, the preferred embodiment of the new and improved outer space alien terror boardgame embodying the principles and concepts of the present invention and generally will be described.

The present invention relates to a boardgame, which is for use by a number of game players, simulates an outer space alien chasing crewmembers about a spaceship. The game includes a gameboard, six player pieces, six player cards, an alien piece, 58 alien cards, 60 crew assignment cards and a pair of dice.

The various components of the present invention, and the manner in which they interrelate, will be described in greater detail hereinafter.

In the preferred embodiment, the game board 10 measures 2' by 3' and is constructed from a plastic material. This gameboard is defined by an upper edge and a lower edge and intermediate connecting edges therebetween. Furthermore, the gameboard is divided into a plurality of different levels: a zero flight deck level colored silver, a first locker room level colored purple, a second operations level colored yellow, a third technical support level colored brown, a fourth resource level colored blue, a fifth life support level 5 colored orange, a sixth crew quarter level colored yellow. Although, the levels have been described in conjunction with specific colors other colors would suffice.

Figure 5:
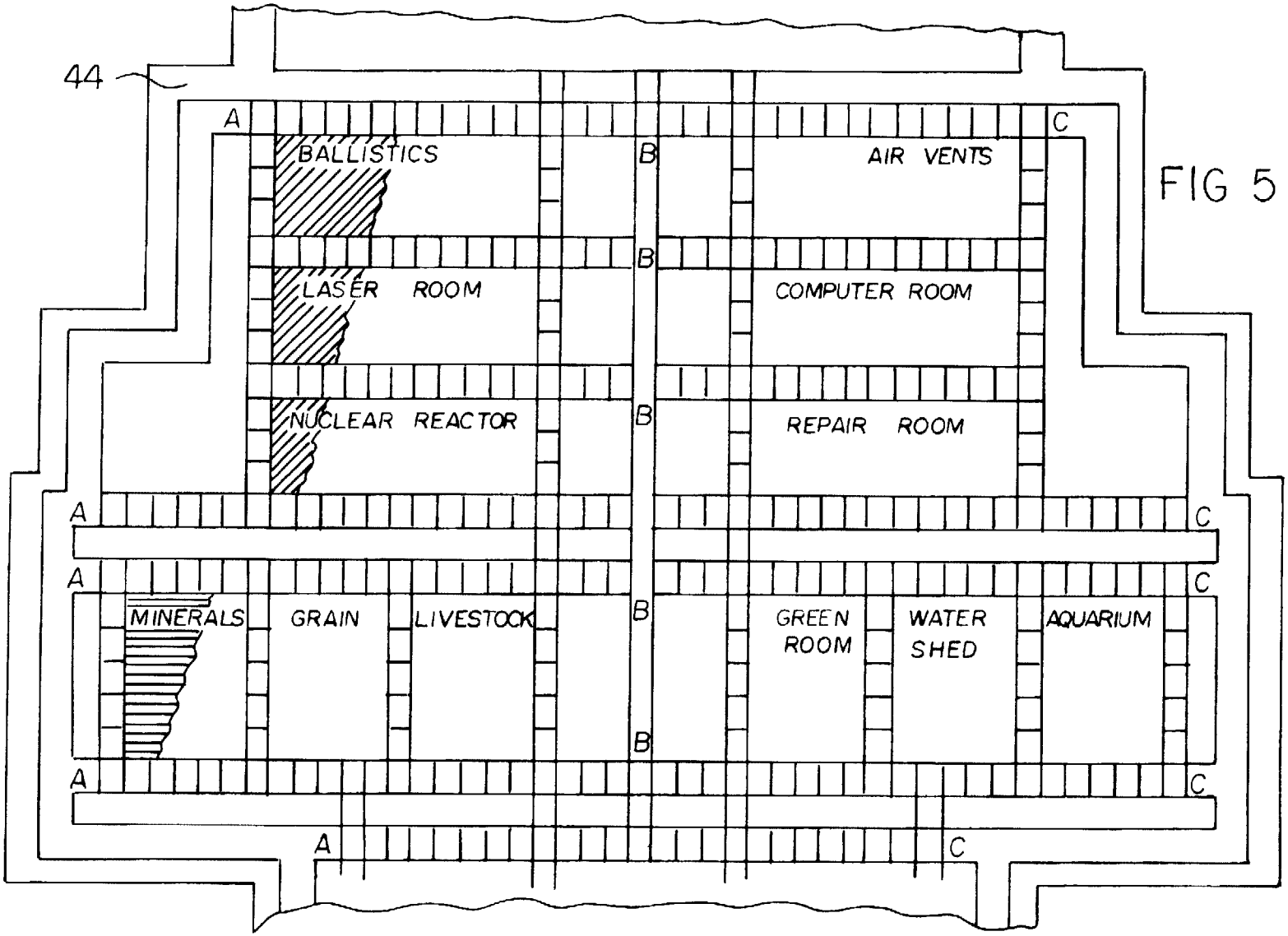
FIG. 5 is a partial view of the gameboard utilized with the present invention.
Figure 7:
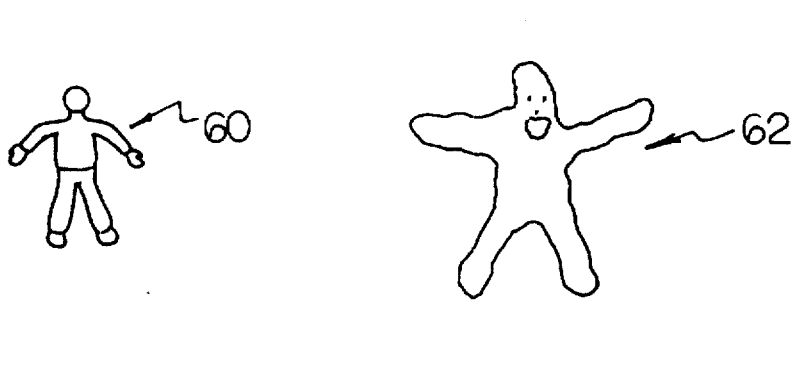
FIG. 7 is a view of a crewmember game piece and an alien game piece.
Figure 8:
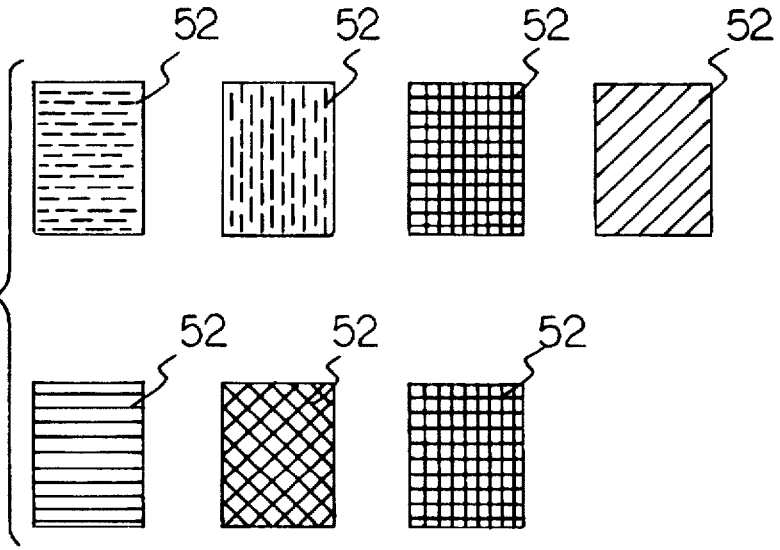
FIG. 8 is a view of six crew assignment cards.
Figure 9:
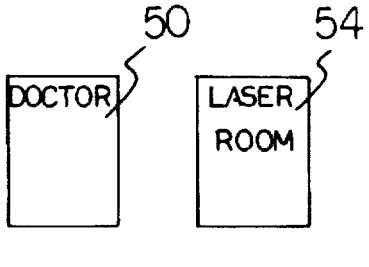
FIG. 9 is a view of showing text of a crew member card and a view showing text of a alien card.

The gameboard is also divided into various rooms. With reference to FIGS. 5 and 6 the gameboard has the following rooms: an escape craft and space hall spaces located on the zero level, six gear closets spaces 1, 2, 3, 4, 5, and 6 respectively; and a gear hall space located on the first level, an observatory space 7, a radio room space 8, an electrical systems space 9, a cockpit space, a tracking space 10, a library technical center space 11, a weapons room space 12 all located upon the second level, a ballistics space 13, an air vent systems space 14, a laser room space 15, a computer room space 16, a nuclear reactors space 17, a repair shop space 18 all located upon the third level, a mineral store space 19, a grain hold space 20, a livestock space 21, a greenhouse space 22, a water shed space 23, and an aquarium space 24 all located upon the fourth level, a operating room space 25, a blood bank space 26, a recreation room space 27, a laboratory space 28, a kitchen space 29, and a mess hall space 30 all located upon fifth level, a doctor quarters space 31, a scientist quarters space 32, a dispatcher quarters space 33, an engineer quarters space 34, a co-pilot quarters space 35 and a captain quarters space 36 all located upon the sixth level.

Also indicated upon the gameboard are a number of hallways which serve to interconnect the different levels. These hallways are segmented into different spaces. In a similar fashion, the gameboard also has two sets of segments which represent ship bulk heads 40 and 42 respectively. These bulk heads, or shuttles, can be used for movement to another ship represented by another gameboard. These are also three flyways depicted upon the gameboard 44, 46 and 48 respectively. These flyways allow for unlimited movement by a gameplayer.

The game also includes various crew member cards 50 for use in placing the initial location of the gameplayer. Specifically, each player first picks a card and then places the card upon the corresponding crew quarter space in the sixth level. More specifically, the game includes: a doctor plastic crewmember card, a scientist plastic crewmember card, a dispatcher plastic crewmember card, an engineer plastic crew-member card, a co-pilot plastic crewmember card, a captain plastic crewmember card, each of the crewmember cards are for use in determining the starting location of each crewmember.

In order for the gameplayers to keep track of their progress upon the gameboard the game includes six crewmember pieces. Specifically, the game includes: a doctor crewmember piece, a scientist crewmember piece, a dispatcher crewmember piece, an engineer crewmember piece, a co-pilot crewmember piece, a captain crewmember piece, each of the crewmember pieces are for indicating a player location upon the gameboard.

During the beginning of each game each player is dealt six plastic crew assignment cards 52, with each crew assignment card 52 representing a different room upon each of the levels of the ship (but not level six which is where the players begin). Thus, the gameplayer must take his crewmember piece to each of the rooms before exiting the gameboard. In total the game includes sixty plastic crew assignment cards 52, each specifying a room upon the gameboard. These cards are color coded to correspond to a specific level color.

As indicated each gameplayer (or group of gameplayers) is responsible for a crewmember piece. However, a gameplayer may also be represented by the plastic alien piece. The plastic alien piece is the opponent to the six crewmembers. A gameplayer is eliminated from the game at anytime the alien and a crewmember are within the same room.

The location of the alien piece is determined by a number of alien cards 54. There are fifty eight plastic alien cards 54 with each card representing a different location upon the gameboard. Finally, the game includes two dice 56 for use in moving the various crewmember pieces about the gameboard.

Game Story

The premise of the game is that the gameboard represents the starship "Phoenix" and is an interplanetary hospital ship. Its's mission is to offer life support and technical assistance to other spacecraft. On its last mission distress signals were received from the mining ship "Arizona". After meeting and docking with it, it was discovered that the craft was empty and devoid of all life. Now, however, an indestructable outer space alien has boarded the Phoenix through the escape craft level. Each crew member must complete 5 room assignments with the aid of flyways and shuttles throughout the ship to get to the escape craft level. As each crew member moves so does the alien. When completing all assignment each player must reach an escape craft to safely blast off the ship without being in the same place at the same time as the alien.

Game Directions

The game can be played by 1 to 7 players.

Each player rolls the dice with the highest number determining who goes first. The first player chooses a crewmember card and playing piece and places it on the corresponding crewquarter room on the board.

When all the players are in their crew quarters the crew assignment cards are separated by level (12 cards each) and shuffled individually. Starting with the first player, one card is dealt from each level(facedown) with the remaining cards put aside. When finished each player should have one room assignment on each level. Cards should be kept confidential as some players may have the same assignment. The alien cards are shuffled and placed and places face down near the board. The alien is then placed on the escape craft level and the game begins.

Using the Dice

After rolling the dice a player has 3 options to move:

use the total of both dice use one die and forfeit the other(which ends any turn including entering a room and rolling doubles forfeit both die remain where they are Doubles If the total of both die are used, the player may roll a second time and continue another turn.

If the player rolls doubles a third time, the turn is ended and they return to their crew quarters. A forfeit is not allowed in this instance.

Moving in the Corridors and Halls

A player may not pass over another player. The same space may not be used again in the same turn. A player may change direction in the gear hall and level 2 providing they do not use the same space or shuttle again.

Entering a Room, the Cockpit and Escape Craft

The exact number of one or both die is required to enter a room. A player may not enter if another player or the alien is already within a room.

Moving from Room to Room

The player must start from a room where their turn was completed. The entrances to both rooms must share the same corridor marker. One or both of the die must equal two. Except for doubles, when entering the adjacent room the player cannot move again.

Entering the Gear and Space Hall

Halls like corridors have no entrance requirements. A player may move freely from the gearhall to the space hall more than one player may enter the gear and space halls. A player may re-enter the gear hall from the space hall, but to re-enter the cockpit from the gear hall requires the exact number.

Shuttles and Flyways Both are free to move around the ship and do not count as a space. When using a shuttle or flyway the player should count: "one-two-shuttle(or flyway)-three-four-etc." A player may not hop from shuttle one to shuttle two or from flyway A to B or C in the same turn. A shuttle may only be entered or exited at a given shuttle stop.

Completing a Turn

When a player finishes moving, an alien card is turned over. The players turn is not considered complete until this is done. This includes passing a turn, forfeiting die or entering the escape craft. when rolling doubles the alien card is not turned until after the final move is completed.

Completing an Assignment

When a player finishes their turn in an assigned room that card is turned in. A player may not enter the escape craft until all assignments have been completed.

Assignment Order

Players should examine all room assignments, before the game, to plant their best route around the ship. Players may complete room assignment in any order they choose. It may be to the players advantage to use the shuttle or the flyway to complete an assignment on a height level first.

Alien Moves

At the and of each players turn an alien card is turned over and placed on a single pile. The alien is then moved to that room or hall on the ship. Any player or players in the room or hall are terminated and removed from the game. The alien card "it waits" signifies that the alien stays where it is that turn. The alien card "it moves twice" signifies that two more cards are to be turned over one at a time. The alien is then moved in sequence from room to room or hall. All players in these rooms or halls are terminated and removed from the game. If an "it waits" card is turned over, it is counted as one of the aliens moves. If an "it moves twice" card is turned over, it not counted as one of the aliens moves. The alien will then make four moves(the alien moves increase by 2 for each additional card).

Miscellaneous

If the alien enters a players crew quarters before they begin their turn in the game, the player is terminated and removed from the game. If a player enters the escape craft and turns over an alien card reading "escape craft", the player is terminated and removed from the game (the players turn was not complete). If the alien has entered the gear hall, players in gear closets or the space hall are safe. If the alien has entered the space hall, players in the gear hall and escape craft are safe. If the alien enters a shuttle or flyway a player may not use or pass that particular one.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A boardgame simulating an alien pursuing the crew members of a spaceship, the boardgame for use by a number of game players, the boardgame comprising in combination:

a plurality of crewmember game pieces, one for each player;

an alien game piece;

a 2' by 3' plastic gameboard having an upper edge and a lower edge and intermediate connecting edges therebetween, the gameboard being divided into a plurality of different levels each level being color coded with a different color, a zero flight deck level colored silver, a first locker room level colored purple, a second operations level colored yellow, a third technical support level colored brown, a fourth resource level colored blue, a fifth life support level colored orange, a sixth crew quarter level colored yellow;

each level having a plurality of spaces representing rooms including an escape craft and space hall spaces located on the zero level, six gear closets spaces and a gear hall space located on the first level, an observatory space, a radio room space, an electrical systems space, a cockpit space, a tracking space, a library technical center space, a weapons room space all located upon the second level, a ballistics space, an air vent systems space, a laser room space, a computer room space, a nuclear reactors space, a repair shop space all located upon the third level, a mineral store space, a grain hold space, a livestock space, a greenhouse space, a water shed space, and an aquarium space all located upon the fourth level, a operating room space, a blood bank space, a recreation room space, a laboratory space, a kitchen space, and a mess hall space all located upon fifth level, a doctor quarters space, a scientist quarters space, a dispatcher quarters space, an engineer quarters space, a co-pilot quarters space and a captain quarters space all located upon the sixth level;

a number of hallways interconnecting the different levels, the hallways being segmented into different spaces;

two sets of segments which represent ship bulk heads allowing movement to another ship represented by another gameboard;

three flyways which allow unlimited movement by a gameplayer;

a plurality of crewmember cards corresponding to the rooms on the sixth level, the crewmember cards include, a doctor plastic crewmember card, a scientist plastic crewmember card, a dispatcher plastic crewmember card, an engineer plastic crewmember card, a co-pilot plastic crewmember card, a captain plastic crewmember card, each of the crewmember cards are for use in determining the starting location of each crewmember;

silty plastic crew assignment cards corresponding to said plurality of spaces representing rooms, each crew assignment card specifying a room upon the gameboard, the cards being color coded to correspond to said plurality of different color coded levels;

fifty eight plastic alien cards each card representing a different room, hallway or flyway upon the gameboard;

two dice for use in determining player movement.

2. A boardgame simulating an alien pursuing the crew members of a spaceship, the boardgame for use by a number of game players, the boardgame comprising in combination:

a plurality of crewmember game pieces, one for each player, an alien game piece;

a gameboard having an upper edge and a lower edge and intermediate connecting edges therebetween, the gameboard being divided into a plurality of different levels each level being color coded with a different color, a zero flight deck level colored silver, a first locker room level colored purple, a second operations level colored yellow, a third technical support level colored brown, a fourth resource level colored blue, a fifth life support level colored orange, a sixth crew quarter level colored yellow, each level having a plurality of spaces representing rooms;

a number of hallways interconnecting the different levels, the hallways being segmented into different spaces;

two sets of segments which represent ship bulk heads allowing movement to another ship represented by another gameboard;

three flyways which allow unlimited movement by a gameplayer;

a plurality of crewmember cards corresponding to the rooms on the sixth level, the crewmembers cards include, a doctor plastic crewmember card, a scientist plastic crewmember card, a dispatcher plastic crewmember card, an engineer plastic crewmember card, a co-pilot plastic crewmember card, a captain plastic crewmember card, each of the crewmember cards are for use in determining the starting location of each crewmember;

sixty crew assignment cards corresponding to said plurality of spaces representing rooms, each crew assignment card specifying a room upon the gameboard, the cards being color coded to correspond to a said plurality of different color coded levels;

fifty eight alien cards each card representing a different room, hallway or flyway upon the gameboard;

two dice for use in determining player movement.

3. The boardgame as described in claim 2 further comprising:

escape craft and space hall spaces located on the zero level, six gear closets spaces and a gear hall space located on the first level, an observatory space, a radio room space, an electrical systems space, a cockpit space, a tracking space, a library technical center space, a weapons room space all located upon the second level, a ballistics space, an air vent systems space, a laser room space, a computer room space, a nuclear reactors space, a repair shop space all located upon the third level, a mineral store space, a grain hold space, a livestock space, a greenhouse space, a water shed space, and an aquarium space all located upon the fourth level, a operating room space, a blood bank space, a recreation room space, a laboratory space, a kitchen space, and a mess hall space all located upon fifth level, a doctor quarters space, a scientist quarters space, a dispatcher quarters space, an engineer quarters space, a co-pilot quarters space and a captain quarters space all located upon the sixth level.

4. The boardgame as described in claim 3 further wherein:

the gameboard, crewmember cards, crewmember assignment cards, and alien cards are all formed of plastic.

* * * * *